United States Patent [19]

Baker et al.

[11] 4,420,243

[45] Dec. 13, 1983

[54] HOLD-DOWN ARRANGEMENT FOR COPY SHEET PICK-OFF SYSTEM

[75] Inventors: James M. Baker, Whitney Point; David L. Vermaat, Port Crane, both of N.Y.

[73] Assignee: Savin Corporation, Stamford, Conn.

[21] Appl. No.: 396,781

[22] Filed: Jul. 9, 1982

[51] Int. Cl.[3] ..... G03G 15/00

[52] U.S. Cl. ..... 355/3 TR; 355/35 H

[58] Field of Search ..... 355/3 TR, 3 R, 3 TE, 355/3 SH, 14 SH; 271/DIG. 2

[56] References Cited

U.S. PATENT DOCUMENTS

| | | | |
|---|---|---|---|
| 4,159,172 | 6/1979 | Tani et al. | 355/3 TR |
| 4,244,648 | 1/1981 | Schultes et al. | 355/3 SH |
| 4,278,341 | 7/1981 | Burgess et al. | 355/3 SH |
| 4,300,830 | 11/1981 | Cormier | 355/3 SH |
| 4,302,093 | 11/1981 | Landa | 355/3 TR |
| 4,351,601 | 9/1982 | Cormier et al. | 355/3 SH |
| 4,387,981 | 6/1983 | Cormier | 355/3 SH |

*Primary Examiner*—R. L. Moses

*Attorney, Agent, or Firm*—Shenier & O'Connor

[57] ABSTRACT

An improved hold-down arrangement for a copy sheet pickoff system in which a pressure finger of insulating material is mounted on the removable transfer corona assembly in such a way that when the assembly is placed in operative position on the machine the pressure finger is located adjacent to the forward edge of the pickoff blade with the operative end of the finger spaced out of contact with the drum by a distance which is approximately equal to the thickness of a sheet of copy paper.

10 Claims, 7 Drawing Figures

HOLD-DOWN ARRANGEMENT FOR COPY SHEET PICK-OFF SYSTEM

FIELD OF THE INVENTION

Our invention is in the field of electrophotographic copiers and more particularly in the field of systems for picking a copy sheet to which the developed image has been transferred off the drum on which the latent image was formed and developed.

BACKGROUND OF THE INVENTION

There are known in the prior art electrophotographic copying machines in which a drum carrying a surface layer of photoconductive material is driven to carry the photoconductive material successively past a charging station at which a uniform electrostatic charge is placed on the surface, then through an exposure station at which the charged photoconductor is subjected to a radiant image of an original to be copied selectively to discharge the photoconductive layer to produce a latent electrostatic image and then through a developing station at which the latent image is subjected to the action of a developer. The developer may either be a dry developer or a liquid developer. In each case, following development of the image there is directed onto the surface of the drum in synchronism with the leading edge of the developed image a sheet of copy material to which the image is to be transferred. The developed image and the sheet of copy material are carried by the drum past a transfer device, such for example as a corona, which causes the developed image to migrate from the surface of the drum to the copy sheet.

After the developed image has been transferred to the copy sheet, the sheet must be removed from the surface of the drum and delivered to the machine user. This operation, particularly where liquid developers are used, is one of the most difficult operations to achieve with a high degree of reliability. Various arrangements have been proposed in the prior art for removing the copy sheet carrying the developed image from the drum.

One of the more reliable arrangements for removing the copy sheet carrying the developed image from the drum and for delivering it to the machine user is shown and described in Ariyama U.S. Pat. No. 3,936,045. In the arrangement shown in that patent, a sheet of copy material to which the image is to be transferred is fed to the drum at a location at which its leading edge is in registry with the leading edge of the image on the drum. The sheet moves together with the image under a transfer corona. In the sheet stripping or pickoff arrangement disclosed in this patent, a thin, narrow metal strip extends over a portion of the periphery of the drum at the rear of the machine in the region of the transfer corona. As the copy sheet is fed to the drum, about seven millimeters of the width of the sheet from the rear edge rides on the thin metal strip rather than on the drum. It will readily be appreciated that, owing to the interposition of the metal strip between the under surface of the copy sheet and the drum at the rear edge, any portion of the developed image which might exist on the drum under the metal strip cannot be transferred to the copy sheet. Thus, there results a narrow band of copy "deletion" along the edge of the copy sheet at the rear of the machine.

After emerging from beneath the corona, the portion of the copy sheet riding along the metal strip engages a struck-up portion thereof which directs the leading rear corner of the sheet up into the nip between a belt and a turn roller which carry the sheet around and reverse its direction to deliver it to the operator.

It will readily be appreciated that owing to the thickness of the metal strip, the portion of the sheet immediately forward of the front edge of the strip is held away from the drum so that development in this region is relatively uncertain and a greater deletion of image than is necessary to achieve pickoff may result. The patentee, in order to obviate this result suggests that a wire carried by the same rear frame plate bracket as that which supports the pickoff blade be biased toward the drum at a location just forward of the forward edge of the pickoff blade so as to hold the copy paper against the drum in this region.

While the pickoff system just described is relatively reliable in removing the copy from the drum, it incorporates a number of disadvantages.

Owing to the fact that the pressure wire contacts the drum it tends to collect toner particles. This condition is aggravated by toner which is picked up by the wire in the course of the reverse development cleaning cycle or anti-deposition cycle which the development electrode of the machine goes through between each copy. This condition further is aggravated when relatively thick toners are used in the developing process.

Toner which is collected on the pressure wire in the manner described hereinabove is deposited on the back of a copy as the copy sheet runs under the pressure finger in the course of an image transfer operation. This produces an unsightly streak down the back of the copy which is particularly objectionable where copying is being done on both sides of the sheet.

The condition described above worsens with time since the pressure wire casing wears down and develops a flat providing a greater surface area around which the liquid developer leaves a meniscus producing an even larger mark on the back of a copy. This condition requires the pressure wire to be cleaned on each service call. Owing to the fact that the pressure wire normally is mounted on the rear frame plate of the machine it is relatively inaccessible and difficult to service.

In addition to the foregoing problem, the photoreceptor may be damaged as a result of the pressure wire riding directly on the surface thereof when no sheet of copy paper is present. A further danger exists of corona electrical arcing as a result of a breakdown of the insulating cover on the pressure wire.

SUMMARY OF THE INVENTION

One object of our invention is to provide an improved hold-down arrangement for a copy sheet pickoff system which overcomes the defects of hold-down arrangements of the prior art.

Another object of our invention is to provide an improved hold-down arrangement for a copy sheet pickoff system which will not damage the photoconductor surface with which it is associated.

A further object of our invention is to provide an improved hold-down arrangement for a copy sheet pickoff system which will not leave a mark on the back of a copy in the course of a transfer operation.

Still another object of our invention is to provide an improved hold-down arrangement for a copy sheet pickoff system which is readily adjustable to accommodate variations in tolerances.

A still further object of our invention is to provide an improved hold-down arrangement for a copy sheet pickoff system which is readily accessible to a service person.

An additional object of our invention is to provide an improved hold-down arrangement for a copy sheet pickoff system which will not result in the danger of corona arcing.

Other and further objects of our invention will appear from the following description.

In general, our invention contemplates the provision of an improved hold-down arrangement for a copy sheet pickoff system in which a pressure finger of insulating material is mounted on the removable transfer corona assembly in such a way that when the assembly is placed in operative position on the machine the pressure finger will be positioned adjacent to the forward edge of the pickoff blade with the operative end of the finger spaced out of contact with the photoconductor drum by a distance which is approximately equal to the thickness of a sheet of copy paper. We adjustably mount the finger on the transfer assembly and make it reversible for easy replacement of the operative end thereof after a period of time in use.

BRIEF DESCRIPTION OF THE DRAWINGS

In the accompanying drawings to which reference is made in the instant specification and which are to be read in conjunction therewith and in which like reference numerals are used to indicate like parts in the various views.

DESCRIPTION OF THE PREFERRED EMBODIMENT

Figure 1:
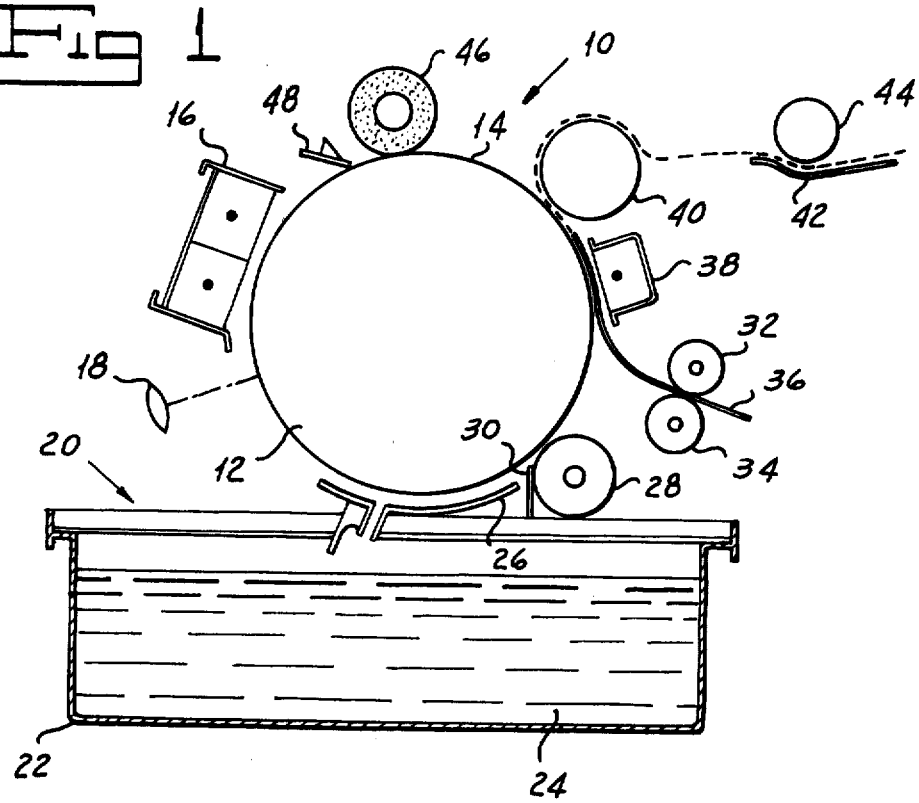
FIG. 1 is a schematic view illustrating the operation of one form of electrostatic copier with which our improved hold-down arrangement for the copy sheet pickoff system may be used.

Referring now to FIG. 1 of the drawings, an electrophotographic copier machine indicated generally by the reference character 10 with which our improved hold-down arrangement can be used includes a drum 12, the surface of which carries a photoconductive layer 14. In a manner known in the art the drum 12 is driven so as to carry the photoconductor 14 past a charging corona 16 which applies a uniform electrostatic charge over the surface of the layer 14 and then past an exposure station at which an exposure device 18 focuses an image of the original to be copied on the surface of the layer 12 so as to result in a latent electrostatic image of the original on the drum 12. After leaving the exposure station, the drum is driven to carry the latent image through a developer station indicated generally by the reference character 20.

A tank 22 at the developer station 20 holds a supply of a liquid developer which may be a suspension of finely divided toner particles in a suitable carrier liquid such as a light hydrocarbon liquid. Suitable apparatus (not shown) pumps developer 24 from the tank 22 into an applicator electrode 26 which subjects the latent image to the action of the developer as the drum 12 carries the latent image past the electrode. In this manner, a developed image is produced on the surface of the drum 12.

After leaving the developer station, the drum 12 carries the developed image past a roller 28 which, in a manner known to the art, is driven in a direction such that its surface moves in a direction opposite to that of the drum so that excess liquid is removed from the surface of the drum by a shearing action. A wiper 30 removes the liquid from the surface of the roller 28 so that the liquid flows back into the tank 22.

Further, in a manner known to the art, when a copying operation is initiated, a sheet of copy material such for example as plain paper 36 is moved from a supply to a position at which its leading edge is in the nip between a pair of registration rolls 32 and 34. Further, in a manner known to the art, as the leading edge of the developed image on the drum 12 arrives at a predetermined location, the registration rolls 32 and 34 are driven so that the leading edge of the sheet 36 arrives at the drum in registration with the leading edge of the developed image. The sheet 36 moves in synchronism with the drum through the space between a transfer corona 38 and the drum. The transfer corona 38 is energized to cause the developed image to move off the drum and onto the under surface of the sheet 36.

As the leading edge of the sheet 36 moves out from under the corona 38, a leading corner of the copy sheet is moved away from the surface of the drum by an arrangement to be described hereinbelow and is directed toward a copy removable system including a turn roller 40 which reverses the direction of movement of the sheet and advances it toward a heater plate 42 against which the sheet is held by a hold-down roller 44. As the sheet moves over the dryer plate 42, vapor is driven out of the sheet so that the copy emerges from the machine in a substantially dry condition.

Figure 2:
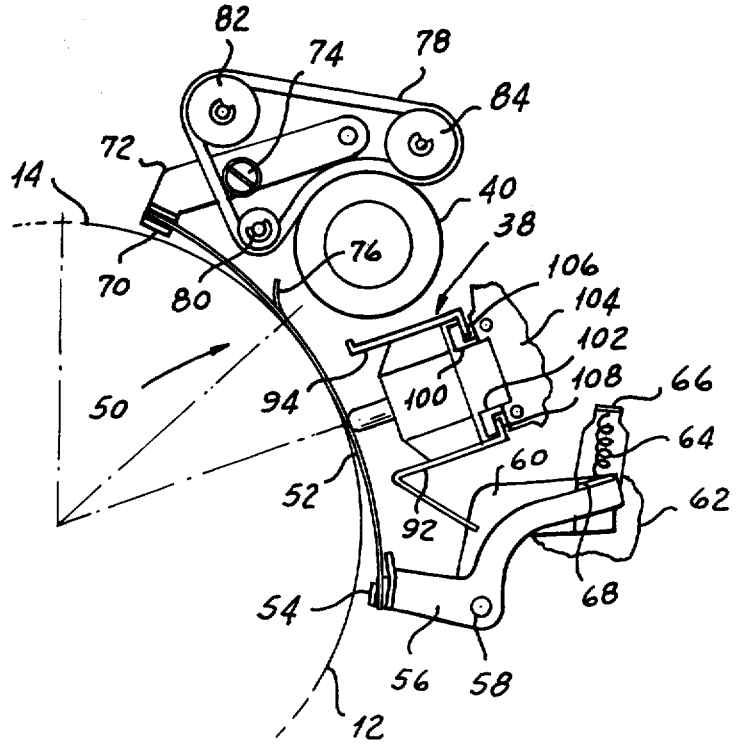
FIG. 2 is a partially schematic view illustrating our improved hold-down arrangement for copy sheet pickoff system which may be employed on the copier illustrated in FIG. 1.
Figure 3:
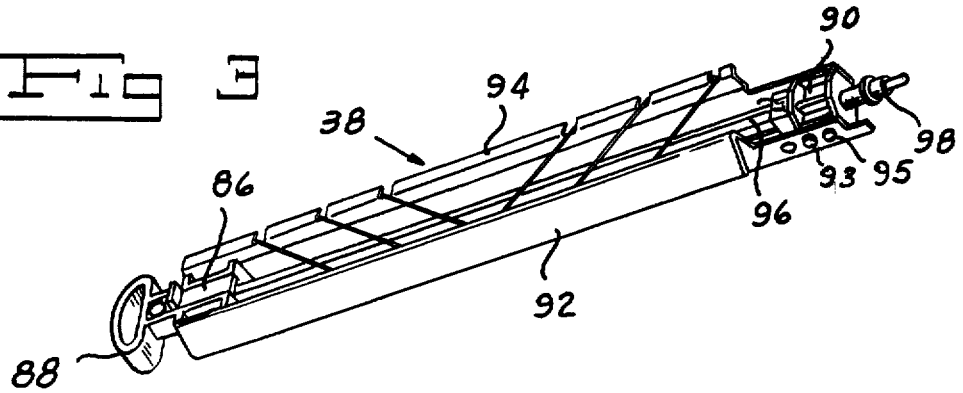
FIG. 3 is a perspective view of the transfer corona assembly of a machine incorporating our improved hold-down arrangement for copy sheet pickoff system.

Referring now to FIG. 2, the copy sheet pickoff system indicated generally by the reference character 50 includes a thin flexible blade 52 of a suitable material such as stainless steel disposed adjacent to the rear edge of the drum 12 so that the rear edge of a sheet 36 being moved onto the drum moves onto the blade 52 rather than directly onto the surface of the drum. In practice, approximately seven millimeters of the paper from the rear edge rides onto the blade 52. The lower end of blade 52 is received by a keeper 54 carried by one arm of a lever 56 pivotally supported on a pin 58 carried by a bracket 60 secured to a machine frame rear plate 62. A spring 64 extending between a lug 66 on the bracket 60 and a flange 68 on the end of lever 56 remote from keeper 54 urges the blade to a position at which it presses against the drum surface adjacent to the rear edge thereof.

The upper end of the blade 52 is received by a keeper 70 carried by a lever 72 supported by a pivot pin 74 on plate 62.

As the edge of the sheet moves along the blade 52 it encounters a struck-up portion 76 of the blade which directs the edge of the sheet upwardly into a nip formed between the rear end of the turn roll 40 and a belt 78 carried by rollers 80, 82, and 84 on the plate 62. The turn roller and belt direct the sheet toward the heater plate 42.

The transfer corona assembly 38 includes a front end insulating block 86 formed with a handle 88 by means of which the assembly may be inserted into the machine and withdrawn therefrom in a manner to be described. The front end insulating block 86 and a rear end insulating block 90 are connected by a pair of shields 92 and 94 secured to the blocks by any suitable means, such for example as screws 93, with the blocks being properly spaced by means of bosses 95 on the blocks which are received in suitable openings in the shields. A corona wire 96 extends between the two blocks 86 and 90 in a manner known to the art. An electrical connector 98 received in block 90 provides an electrical connection to the corona wire when the transfer corona assembly 38 is inserted in position on the copy machine.

The machine with which our arrangement is used, includes a pair of rails 100 and 102, extending between the front frame plate 104 and the rear frame plate 62. Shields 94 and 92 are provided with respective longitudinally extending flanges 106 and 108 which are received by the rails 100 and 102 when the assembly 38 is slid into position on the machine.

Figure 4:
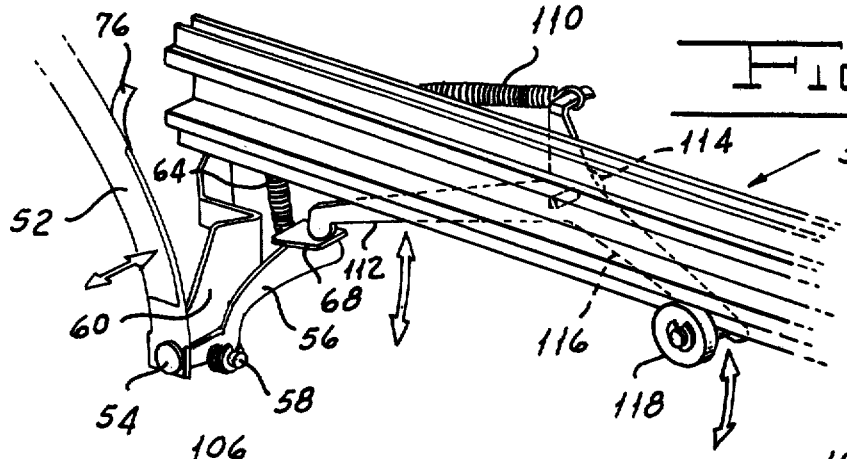
FIG. 4 is a fragmentary perspective view illustrating one feature of the copy sheet pickoff system with which our improved hold-down arrangement may be used.
Figure 5:
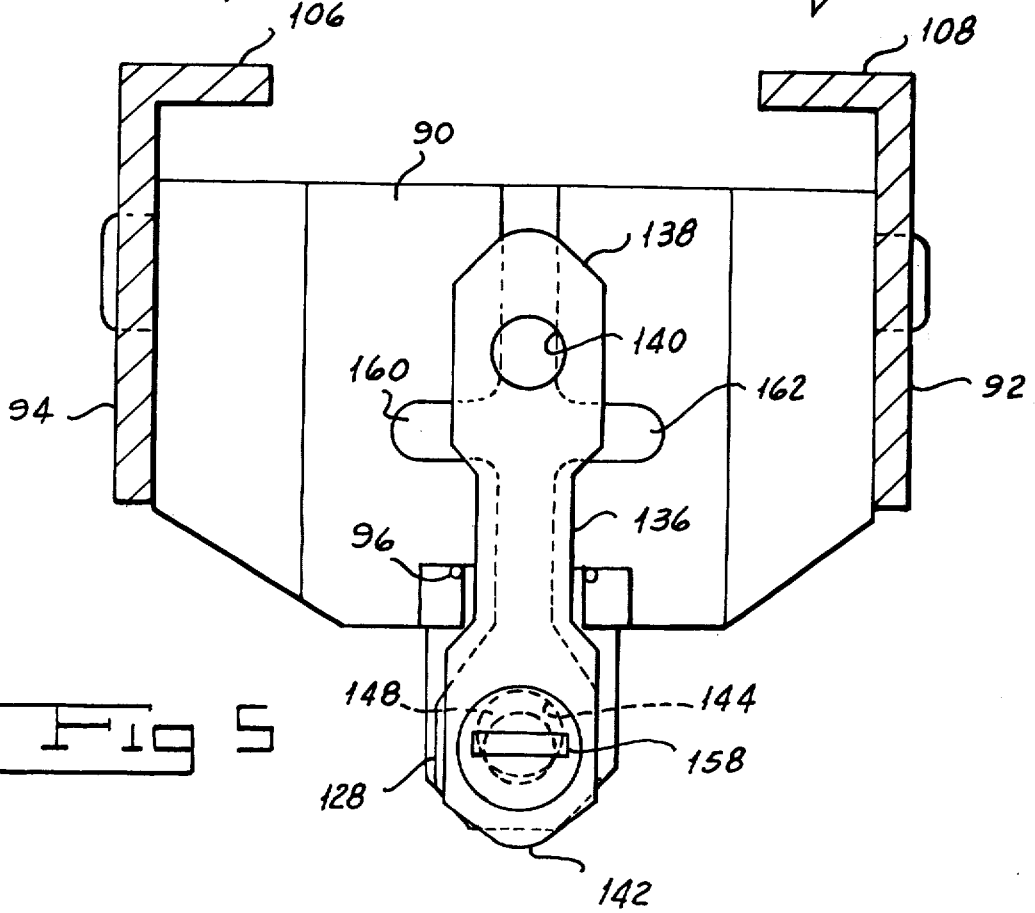
FIG. 5 is a sectional view of the transfer corona arrangement of a machine incorporating our improved hold-down arrangement for copy sheet pickoff system drawn on an enlarged scale.
Figure 6:
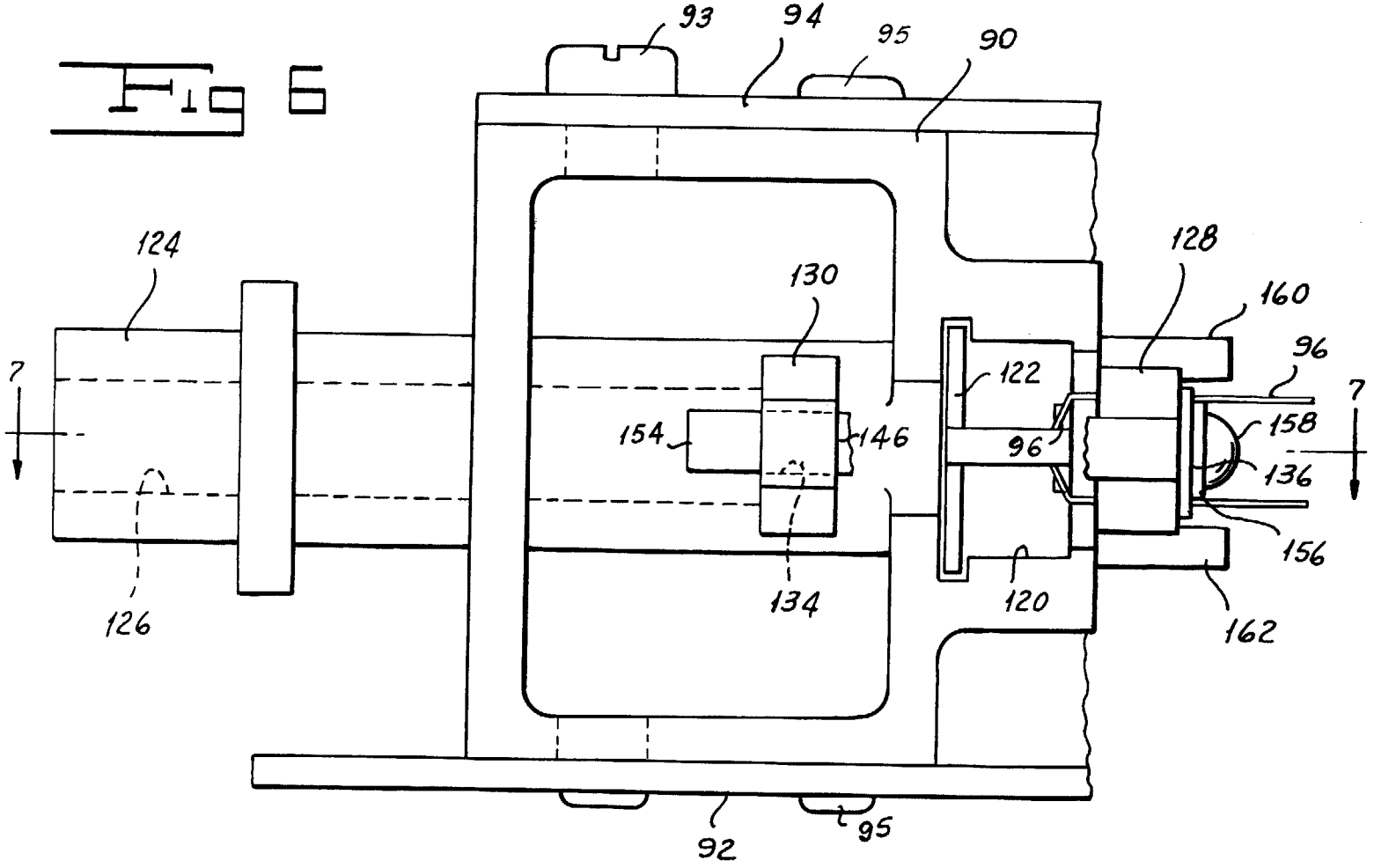
FIG. 6 is a fragmentary bottom plan of the rear portion of the transfer corona assembly of a machine incorporating our improved hold-down arrangement for copy sheet pickoff drawn on an enlarged scale with parts removed and with other parts broken away.
Figure 7:
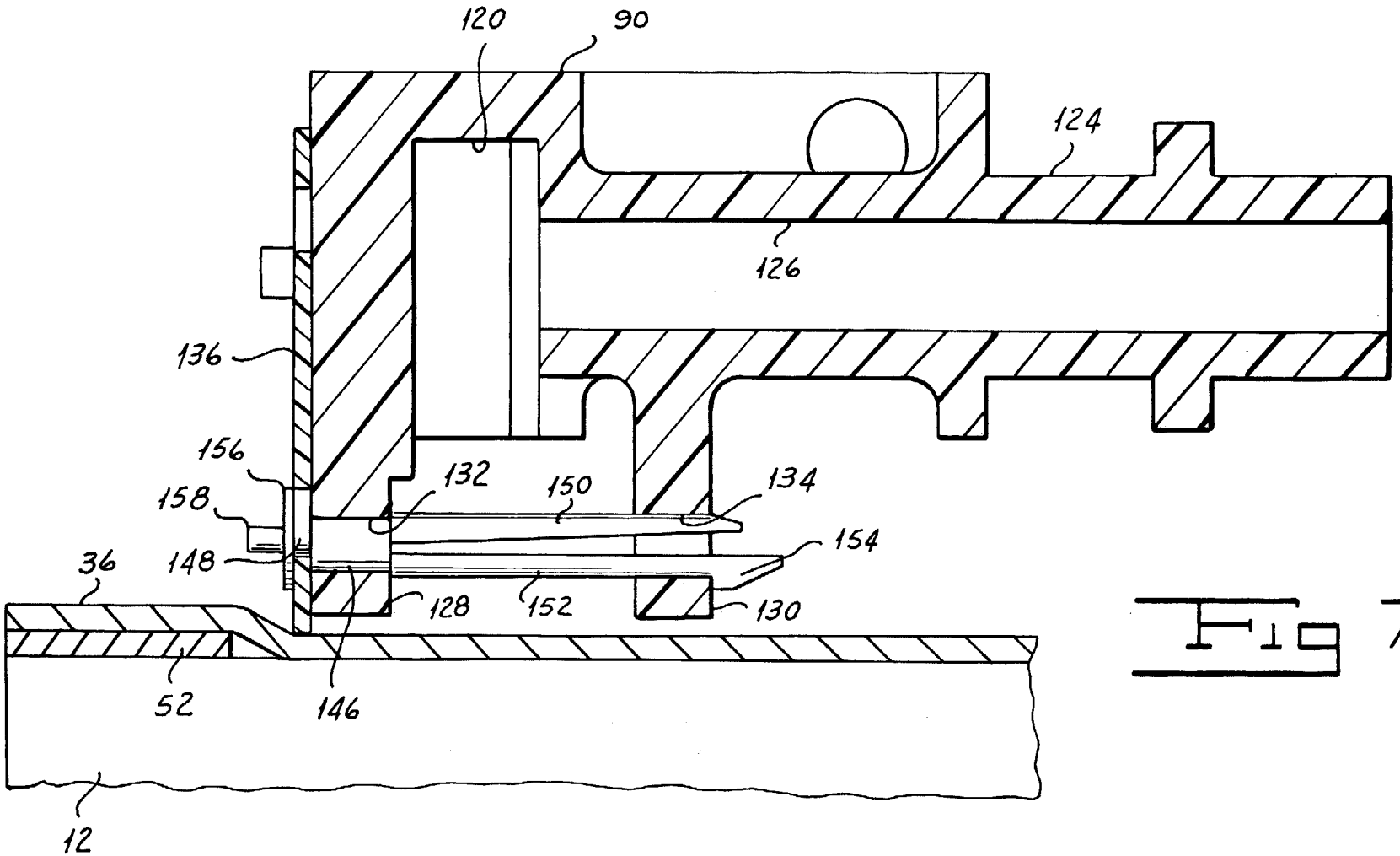
FIG. 7 is a fragmentary sectional view of the rear portion of the transfer corona assembly of a copier incorporating our improved hold-down arrangement for copy sheet pickoff system taken along the line 7—7 of FIG. 6.

The machine with which our arrangement is used further includes means for moving the blade 52 out of contact with the drum edge when the transfer corona 38 is moved out of the machine. A spring 110 acts on a lever having arms 112 and 116 to rotate the lever in a counter-clockwise direction as viewed in FIG. 4 in the absence of the transfer corona 38. When this occurs, the arm 112 acts on flange 68 to pivot lever 56 around pin 58 in a clockwise direction as viewed in FIGS. 2 and 4 to lift the blade 52 out of engagement with the drum 12, thus to facilitate removal of the drum from the machine. As the corona assembly 38 is reinserted in the machine, the under side thereof engages a roller 118 on lever arm 116 to rotate the lever in a clockwise direction as viewed in FIG. 4 against the action of spring 110. When this occurs, arm 112 moves away from flange 68 to permit spring 64 to pivot lever 56 around pin 58 in a counter-clockwise direction as viewed in FIG. 2 to restore the pickoff blade to operative condition with relation to the drum 12.

Block 90 is formed with a recess 120 in the underside thereof for receiving the corona wire retainer 122. A cylindrical extension 124 on the block 90 has a bore 126 for receiving the connector 98 which provides an electrical connection with the wire retainer 122.

In our improved hold-down arrangement for the copy sheet pickoff system, we form the block 90 which may be molded of any suitable synthetic resin, such for example as a polyester resin, with a pair of downwardly extending projections 128 and 130 having respective bores 132 and 134. The hold-down finger 136 of our arrangement is provided with a first working end 142 and associated hole 144 as well as with a second working end 138 and associated second hole 140. We form finger 136 from any suitable material such as "Mylar" which is the registered trademark of E. I. du Pont de Nemours & Co. for a highly durable polyethylene terephthalate resin.

Our arrangement includes a polyester split pin 146 for adjustably assembling finger 136 on the block 90. In so doing, the finger 136 is assembled on an eccentric 148 on the pin. Next, the pin legs 150 and 152 are inserted through the bores 132 and 134 until a nose 154 on leg 152 snaps into position beyond the end of bore 134. In this position of the parts a flange 156 forming part of the pin 146 is flushed against the outer edge of the extension 128. An actuator 158 formed on the end of the pin permits the pin to be rotated. In this relative position of the parts the upper portion of the finger 136 is located between a pair of guides 160 and 162 formed on the block 90.

In use of our improved copy sheet hold-down arrangement when no copy sheet is at the transfer station, finger 136 is out of engagement with the drum 12 and very little, if any, toner accumulates on the finger even in the course of the cleanup cycle. When a sheet of copy material passes through the transfer station the finger 136 engages the back of the sheet adjacent to the inner edge of blade 52 to ensure that as nearly complete a copy as is possible is made. At the same time substantially no toner is deposited on the back of the sheet by the finger 136. This is especially important when copying on both sides of the copy sheets.

The arrangement of the eccentric 148 permits of adjustment of the position of the finger to account for variations in tolerances. The mounting of the finger, moreover, permits it to be reversed when one end has worn excessively.

It will be seen that we have accomplished the objects of our invention. We have provided an improved copy sheet hold-down arrangement for the pickoff system which will not appreciably mark the back of a copy. It substantially eliminates the problem of transfer corona arcing. It will not mark the photoconductor.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. In an electrostatic copier having a moving surface from which a developed image is to be transferred at a transfer station to a copy sheet fed to the surface at a first location just ahead of the transfer station and adapted to be removed from said surface at a second location beyond said transfer station with reference to the direction of movement of the surface and having a copy sheet removal system including a member extending over a portion of the edge of said surface from said first location to said second location whereby an edge of said copy sheet rides over said member as the sheet passes through said transfer station, the improvement comprising a copy sheet hold-down element, and means mounting said element at said transfer station closely adjacent to and inboard of the edge of said member remote from said surface edge and closely adjacent to and in spaced relationship to said surface to hold the portion of a copy sheet adjacent to said member inner edge close to said surface.

2. The improvement as in claim 1 in which the space between said element and said drum is approximately equal to the thickness of a normal sheet of said copy material.

3. In an electrostatic copier having a rotatable drum from which a developed image is to be transferred at a transfer station to a copy sheet fed to the drum at a first location just ahead of said transfer station and adapted to be removed from said drum at a second location beyond said transfer station with reference to the direction of rotation of said drum and having a copy removal system including a narrow strip extending over a portion of the periphery of an edge of said drum from said first location to said second location whereby an edge of said copy sheet rides over said strip as the sheet passes through the transfer station, the improvement comprising a copy sheet hold-down finger and means mounting said finger at said transfer station closely adjacent to and inboard of the edge of said strip remote from said drum edge with the end of said finger closely adjacent to and spaced from the surface of said drum to hold down the portion of a copy adjacent to said strip inboard edge.

4. The improvement as in claim 3 in which the space between the end of said finger and said drum is substantially equal to the thickness of a normal sheet of copy material.

5. In an electrostatic copier having a rotatable drum from which a developed image is to be transferred at a transfer station to a copy sheet fed to the drum at a first location just ahead of said transfer station and adapted to be removed from said drum at a second location beyond said transfer station with reference to the direction of rotation of said drum and having a copy removal system including a narrow strip extending over a portion of the periphery of an edge of said drum from said first location to said second location whereby an edge of said copy sheet rides over said strip as the sheet passes through the transfer station and having a manually removable and reinsertable transfer unit, the improvement comprising a copy sheet hold-down finger and means mounting said finger on said transfer unit at a location at which it is positioned closely adjacent to and inboard of the edge of said strip remote from said drum edge with the end of said finger closely adjacent to and spaced from the surface of said drum when said transfer unit is in position on said machine.

6. In an electrostatic copier having a drum from which a developed image is to be transferred to a copy sheet, a transfer unit, means mounting said transfer unit for movement between an assembled condition on said copier in operative relationship with said drum and a disassembled condition out of said copier, a copy sheet hold-down finger and means mounting said finger on said transfer unit at a location at which the end thereof is in closely spaced relationship to the surface of the drum in the assembled condition of said transfer unit.

7. In an electrostatic copier having a drum from which a developed image is to be transferred to a copy sheet at a transfer station, a copy sheet hold-down finger, and means mounting said finger at said transfer station with the end thereof in spaced relationship to said drum, said mounting means comprising means mounting said finger for rectilinear movement and manually operable means for adjusting the position of said finger.

8. In an electrostatic copier having a drum from which a developed image is to be transferred to a copy sheet at a transfer station, a reversible copy sheet hold-down finger having opposed ends and manually operable means for reversibly mounting said finger at said transfer station selectively to position one of said ends in predetermined spaced relationship to the surface of said drum.

9. In an electrostatic copier having a drum from which a developed electrostatic image is to be transferred to a copy sheet at a transfer station, a copy sheet hold-down finger having an opening therein and means including an eccentric in said opening for mounting said finger at said transfer station with the end thereof in spaced relationship to the surface of said drum and manually operable means for rotating said eccentric to adjust the position of said finger end relative to said surface.

10. In an electrostatic copier having a drum from which a developed electrostatic image is to be transferred to a copy sheet at a transfer station, a reversible copy sheet hold-down finger having opposed ends and a pair of longitudinally spaced openings and means including an eccentric selectively received in one of said openings for reversibly mounting said finger at said transfer station selectively to position one of said ends in predetermined spaced relationship to the surface of said drum.

* * * * *